US005994992A

United States Patent [19]

Yamada et al.

[11] Patent Number: 5,994,992

[45] Date of Patent: Nov. 30, 1999

[54] CHOKE COIL

[75] Inventors: Tatsuyuki Yamada, Fukui-ken; Takaaki Ooi, Takefu; Koichi Yamaguchi, Fukui-ken, all of Japan

[73] Assignee: Murata Manufacturing Co., Ltd., Nagaokakyo, Japan

[21] Appl. No.: 08/987,622

[22] Filed: Dec. 9, 1997

[30] Foreign Application Priority Data

Dec. 9, 1996 [JP] Japan ..... 8-328543

[51] Int. Cl.[6] ..... H01F 27/24

[52] U.S. Cl. ..... 336/212; 336/198; 336/83; 336/215

[58] Field of Search ..... 336/180, 181, 336/82, 83, 220, 221, 222, 212, 215, 178, 198

[56] References Cited

U.S. PATENT DOCUMENTS 5,028,904 7/1991 Kurano ..... 336/96
5,506,559 4/1996 Yamaguchi et al. ..... 336/83
5,629,661 5/1997 Ooi et al. ..... 336/198
5,635,890 6/1997 Yamaguchi et al. ..... 336/83
5,635,891 6/1997 Miyoshi et al. ..... 336/90

*Primary Examiner*—Lincoln Donovan
*Assistant Examiner*—Tuyen Nguyen
*Attorney, Agent, or Firm*—Burns, Doane, Swecker & Mathis, LLP

[57] ABSTRACT

A choke coil is provided having a highly efficient normal-mode inductance component. The choke coil comprises a bobbin, a magnetic core, and a pair of windings. The bobbin has a core portion, and flanges which are respectively provided at both outer ends and at the center of the core portion. The forward end of the central flange, placed near the magnetic core, extends longer than the forward ends of the other flanges located at the ends of the core portion. In one embodiment, the forward end of the central flange is provided with a hole for receiving the magnetic core.

18 Claims, 6 Drawing Sheets

CHOKE COIL

BACKGROUND OF THE INVENTION

This application corresponds to Japanese Patent Application No. 8-328543, filed on Dec. 9, 1996, which is hereby incorporated by reference in its entirety herein.

1. Field of the Invention

The present invention generally relates to choke coils and more particularly relates to a choke coil used for suppressing noise generated in or entering electronic equipment.

2. Description of the Related Art

Typically, since a common-mode choke coil has a slight leakage inductance component in the normal mode, this choke coil is effective against normal-mode noise, as well as against common-mode noise. If, however, the normal-mode noise is too strong, a normal-mode choke coil should be independently used to reduce such noise.

To address the above-described needs, the choke coil shown in FIG. 11 has been proposed as a coil for effectively suppressing both common-mode noise and normal-mode noise. This choke coil is formed of a magnetic bobbin 100, a pair of windings 105 and 106, and a magnetic core 110. The magnetic bobbin 100 has a core portion 101, and flanges 102, 103 and 104 which are respectively provided at both outer ends and at the center of the core portion 101. The windings 105 and 106 are wound around the core portion 101. One side of the magnetic core 110 is inserted into a hole 101*a* formed in the core portion 101.

In the choke coil configured as described above, a common-mode noise current flows into the pair of windings 105 and 106 so as to generate a magnetic flux in each of the windings 105 and 106. The sets of generated magnetic flux are combined and are converted into thermal energy in the form of eddy current loss in the magnetic core 110, and then attenuated. The common-mode noise is thus reduced.

Furthermore, a normal-mode noise current flows into the windings 105 and 106 so as to generate a magnetic flux in each of the windings 105 and 106. The generated magnetic flux is converted into thermal energy in the form of eddy current loss in the magnetic bobbin 100, and, as a result, then attenuated. The normal-mode noise is thus suppressed.

In the above known type of choke coil, since the windings 105 and 106 are wound around substantially the overall peripheral area of the core portion 101, the flange 104 is thickened (e.g., widened) in order to reliably establish an insulation between the windings 105 and 106. For example, the thickness of the flange 104 is set so that the distance L from one end of the winding 105 to one end of the winding 106 along the exposed surface of the flange 104 is approximately 3.2 mm. On the other hand, the heights T of the flanges 102, 103 and 104 of the bobbin 100 have heretofore not been a consideration in the design of these bobbins, and the heights T are generally set so as to have the same value.

In the conventional choke coil, the gap D between the forward end of the flange 104 and the magnetic core 110 is comparatively large, as illustrated in FIG. 12. Consequently, the magnetic flux generated due to the flow of the normal-mode noise current hardly passes through the magnetic core 110. This design therefore fails to use the magnetic core 110 to provide a magnetic flux path formed by the flow of the normal-mode noise current. As a result, the above-described conventional choke coil obtains a normal-mode inductance component having low efficiency.

SUMMARY OF THE INVENTION

Accordingly, it is an exemplary object of the present invention to provide a choke coil which obtains a normal-mode inductance component with high efficiency.

In order to achieve the above object, according to the present invention, there is provided a choke coil comprising a bobbin having a core portion provided with a hole, and flanges which are respectively provided at both outer ends and at the center of the core portion. The bobbin is at least partially formed of a magnetic member. The choke coil includes a pair of windings wound around the peripheral surface of the core portion. A magnetic core is inserted into the hole provided in the core portion. The forward end of the central flange extends from the core portion of the bobbin longer (i.e., a greater distance) than the forward ends of the other flanges provided at both outer ends of the core portion of the bobbin.

In the above choke coil, the flange provided at the center of the core portion of the bobbin preferably faces 20% or more of the cross-sectional peripheral surface of the magnetic core. Moreover, the flange provided at the center of the core portion of the bobbin can have a projection, a recessed portion, or a hole at the forward end thereof placed near the magnetic core, wherein the projection, recessed portion, and the hole face the magnetic core. Further, a magnetic cover can be provided on the peripheral surfaces of the flanges of the bobbin, except for at least a region surrounded by the magnetic core, thereby forming a closed magnetic path by the magnetic cover and the magnetic material of the bobbin.

With the above configuration, a common-mode noise current flows into a pair of windings to generate a magnetic flux in each of the windings. The two sets of magnetic flux are combined and converted into thermal energy in the form of eddy current loss in the magnetic core, and are then attenuated. The common-mode noise current is thus reduced.

On the other hand, a normal-mode noise current flows into a pair of windings to produce a magnetic flux in the windings. The generated magnetic flux is converted into thermal energy in the form of eddy current loss within the magnetic bobbin and is then attenuated. The normal-mode noise current is thus suppressed.

Further, the forward end of the flange provided at the center of the core portion of the bobbin is placed in proximity with the magnetic core, and the gap therebetween is smaller than that of known choke coils. This makes it easy for the magnetic flux generated by the flow of the normal-mode noise current to pass through the magnetic core. Thus, the magnetic core can be used with high efficiency to form a magnetic flux path generated by the normal-mode noise current as well as a magnetic flux path generated by the common-mode noise current.

Additionally, a closed magnetic path is formed by the magnetic cover and the magnetic member of the bobbin. Thus, the magnetic flux generated by the flowing of the normal-mode noise current partially circulates in the closed magnetic path, thereby further increasing the normal-mode inductance component.

BRIEF DESCRIPTION OF THE DRAWINGS

The foregoing, and other, objects, features and advantages of the present invention will be more readily understood upon reading the following detailed description in conjunction with the drawings in which:

FIGS. 4A and 4B illustrate the common-mode noise suppressing function exhibited by the choke coil shown in FIG. 1, wherein FIG. 4A is a magnetic circuit diagram, and FIG. 4B is an electrical equivalent circuit diagram;

FIGS. 5A and 5B illustrate the normal-mode noise suppressing function exhibited by the choke coil shown in FIG. 1, wherein FIG. 5A is a magnetic circuit diagram, and FIG. 5B is an electrical equivalent circuit diagram;

FIGS. 9A and 9B are distribution diagrams illustrating the simulated magnetic flux generated by a normal-mode current, wherein FIG. 9A illustrates the magnetic flux distribution of the choke coil shown in FIG. 8, and FIG. 9B illustrates the magnetic flux distribution of a known choke coil;

DETAILED DESCRIPTION

Figure 1:
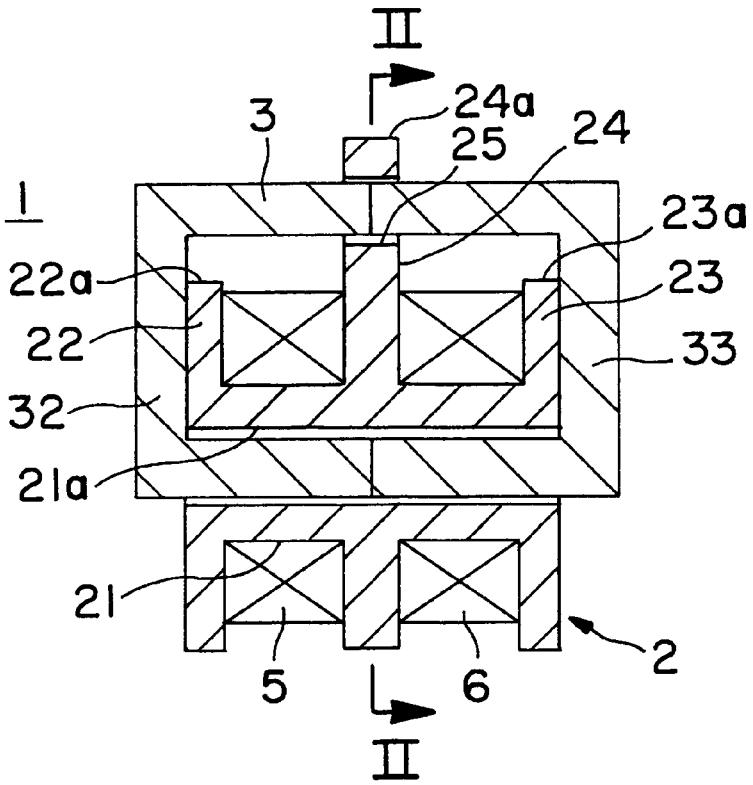
FIG. 1 is a cross-sectional view illustrating a choke coil according to a first exemplary embodiment of the present invention.

An explanation will now be given of a choke coil of the present invention with reference to the accompanying drawings. In the following embodiments, the same elements and portions thereof are designated with like reference numerals.

First Embodiment: FIGS. 1 through 5

Figure 2:
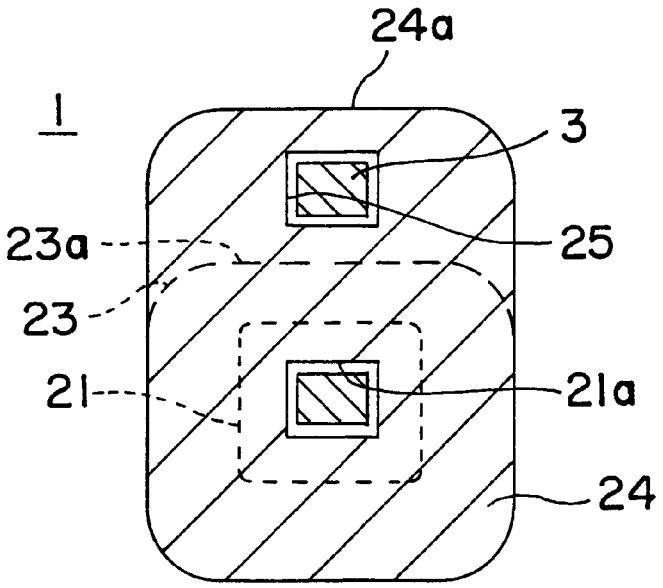
FIG. 2 is a sectional view taken along line II—II of FIG. 1.

Referring to FIGS. 1 and 2, the illustrated choke coil 1 is formed of a bobbin 2, a magnetic core 3, and a pair of windings 5 and 6. The bobbin 2 has a core portion 21, and flanges 22, 23 and 24 which are respectively provided at both outer ends and at the center of the core portion 21. The winding 5 is wound around the outside surface of the left side of the core portion 21, while the winding 6 is wound around the outside surface of the right side of the core portion 21. The windings 5 and 6 are partitioned by the flange 24. In the first embodiment, a hole 21*a* of the core portion 21 is provided which is rectangular in cross section, and the shape of the flanges 22, 23 and 24 are also generally rectangular, although other shapes (e.g., circular) can be used. The bobbin 2 can be made of a magnetic material having a relative magnetic permeability of, for example, one or greater (in one exemplary embodiment, the relative permeability can be 24 or greater, e.g. several dozens). More specifically, a material produced by kneading a Ni—Zn or Mn—Zn ferrite powder (or like material) and a resin binder can be used.

The forward end 24*a* of the flange 24 is located closer to the magnetic core 3 than the flanges 22 and 23. The forward end 24*a* of flange 24 also extends out further than the forward ends 22*a* and 23*a* of the flanges 22 and 23, respectively. The flange 24 includes a hole 25 for receiving the magnetic core 3.

The magnetic core 3 can be formed in a hollow-rectangular shape by respectively inserting angular U-shaped magnetic members 32 and 33 into respective opposite ends of the hole 21*a* of the core portion 21 and the hole 25 of the flange 24 and then abutting the members 32 and 33 with each other. The magnetic members 32 and 33 are then fixed (e.g., attached to one another) by means such as adhesive, varnish, etc. The gap between the magnetic core 3 and the hole 25 is set, for example, at 2.0 mm or less. If the gap exceeds 2.0 mm, the passing of the magnetic flux produced by the flow of the normalmode noise current through the magnetic core 3 is impaired. This gap is preferably set within a range of from approximately 0.3 to 0.5 mm to enhance and stabilize the passage of the above-described magnetic flux. The magnetic core 3 can be preferably made of, for example, a material having a relative magnetic permeability of several thousands or more. More specifically, a ferrite or amorphous material, or like material, can be used to fabricate the magnetic core 3.

In the choke coil 1 constructed as described above, the forward end 24*a* of the flange 24 is placed in proximity to the magnetic core 3, and the gap therebetween is smaller than that of conventional choke coils. This makes it easy for the magnetic flux generated by the normal-mode noise current to pass through the magnetic core 3 via the forward end 24*a* of the flange 24. Thus, the magnetic core 3 can be used not only as a magnetic flux path formed by the common-mode noise current but also as a magnetic flux path formed by the normal-mode noise current. As a result, it is possible to provide a choke coil 1 that is capable of efficiently obtaining a large normal-mode inductance component, i.e., a choke coil 1 which is able to efficiently reduce the normal-mode noise current.

Figure 3:
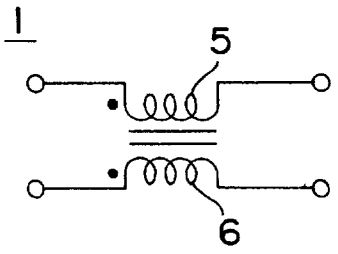
FIG. 3 is diagram illustrating an electrical equivalent circuit of the choke coil shown in FIG. 1.

FIG. 3 is a diagram illustrating an electrical equivalent circuit of the choke coil 1.

Figure 4A:
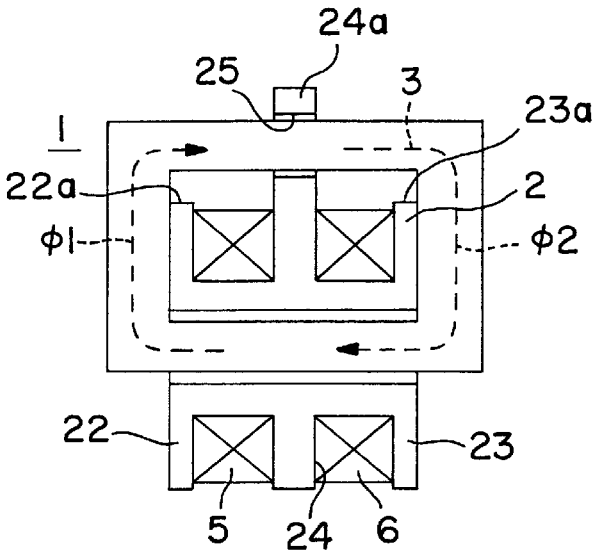

The common-mode noise suppressing function of the choke coil 1 will first be described with reference to FIGS. 4A and 4B.

Figure 4B:
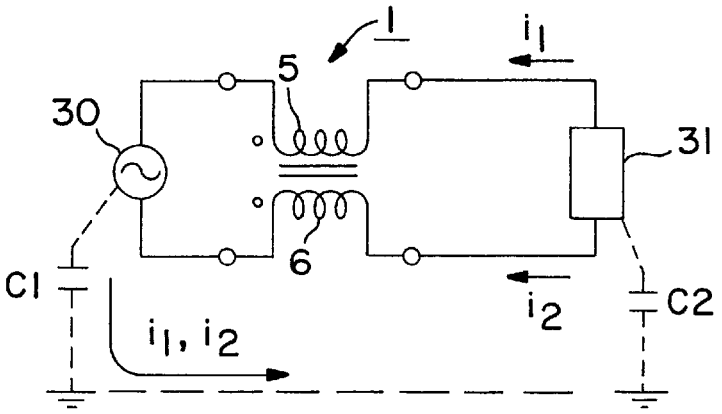

The choke coil 1 is electrically connected, as illustrated in FIG. 4B, to two signal lines disposed between a power source 30 and a load 31 (such as the load associated with attached electronic equipment). A stray capacitance C1 is generated between the power source 30 and a ground, while a stray capacitance C2 is produced between the load 31 and a ground. When common-mode noise currents $i_1$ and $i_2$ flow in the respective signal lines, as indicated by the arrows in FIG. 4B, two sets of magnetic flux $\phi$1 and $\phi$2 are generated, as shown in FIG. 4A, in the windings 5 and 6. The two sets of magnetic flux $\phi$1 and $\phi$2 are combined and are progressively attenuated while circulating in the closed magnetic path formed in the magnetic core 3. This is because the two sets of magnetic flux $\phi$1 and $\phi$2 are converted into thermal energy in the form of eddy current loss. The common-mode noise currents $i_1$ and $i_2$ thus become reduced due to this attenuation.

The normal-mode suppressing function of the choke coil 1 will now be explained with reference to FIGS. 5A and SB.

Figure 5A:
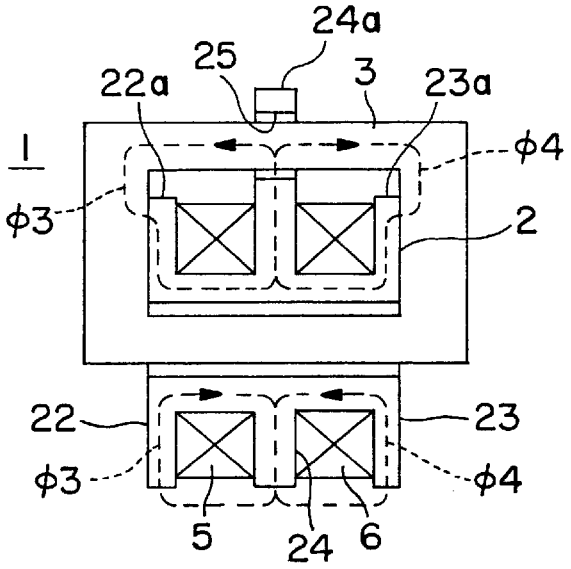
Figure 5B:
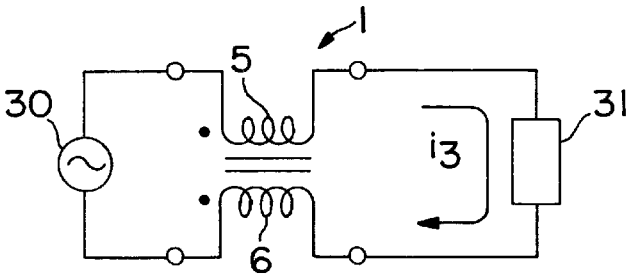

When a normal-mode noise current $i_3$ flows, as illustrated in Fig. SB, in the two signal lines, as indicated by the arrow shown in FIG. 5B, two sets of magnetic flux $\phi$3 and $\phi$4 are generated, as illustrated in FIG. 5A, in the windings 5 and 6. The two sets of magnetic flux $\phi$3 and $\phi$4 are converted into thermal energy in the form of eddy current loss and are progressively attenuated while circulating in the magnetic path formed by the bobbin 2 and the magnetic core 3. The normal-mode noise current $i_3$ is thus suppressed due to this attenuation.

Second, Third and Fourth Embodiments: FIGS. 6 through 9

Figure 6:
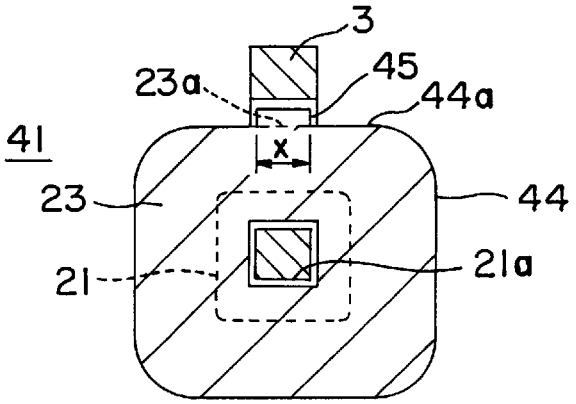
FIG. 6 is a sectional view illustrating a choke coil according to a second exemplary embodiment of the present invention.
Figure 7:
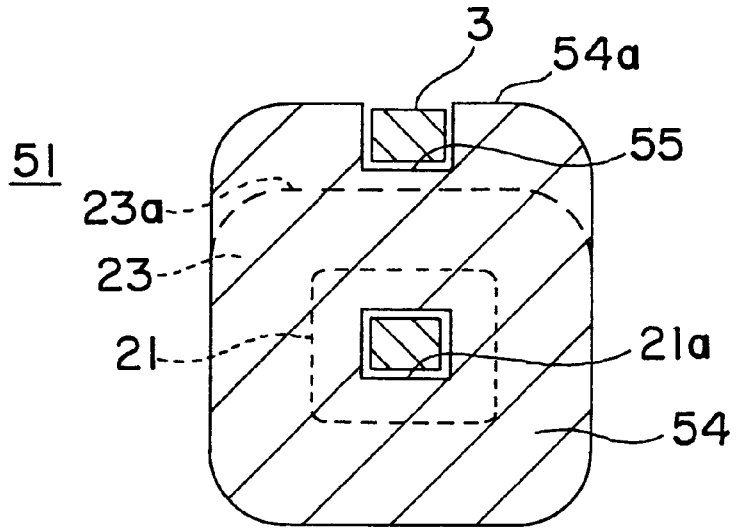
FIG. 7 is a sectional view illustrating a choke coil according to a third exemplary embodiment of the present invention.
Figure 8:
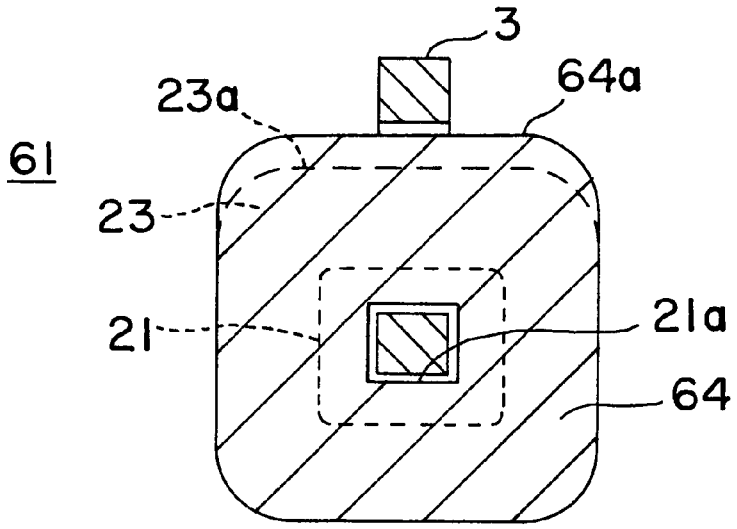
FIG. 8 is a sectional view illustrating a choke coil according to a fourth exemplary embodiment of the present invention.

Choke coils 41, 51 and 61 illustrated in FIGS. 6, 7 and 8, respectively, are configured in a manner similar to the choke coil 1 of the first embodiment shown in FIG. 2, except for the shapes of flanges 44, 54 and 64.

In the choke coil 41 of the second embodiment, a projection 45 is provided, as shown in FIG. 6, on the forward end 44*a* of the flange 44 facing the magnetic core 3. Due to this projection 45, the forward end 44*a* of the flange 44 is located closer to the magnetic core 3 than the forward ends 22*a* and 23*a* of the flanges 22 and 23. The width X of the projection 45 is set so that the projection 45 faces approximately 20% or greater of the length of a peripheral surface of the magnetic core 3. If the width X of the projection 45, i.e., the length of the flange 44 facing the magnetic core 3, is less than approximately 20% of the length of the peripheral surface of the core 3, the passing of the magnetic flux generated by the normal-mode noise current passing through the magnetic core 3 is impaired. Furthermore, the gap between the magnetic core 3 and the projection 45 is preferably set at, for example, approximately 2.0 mm or less.

With this arrangement, the magnetic flux generated by the normal-mode noise current is able to pass through the magnetic core 3 more easily via the projection 45. It is thus possible to use the magnetic core 3 not only as a magnetic flux path formed by the common-mode noise current but also as a magnetic flux path formed by the normal-mode noise current. As a consequence, the choke coil 41 efficiently provides a large normal-mode inductance component.

In the choke coil 51 of the third embodiment, the forward end 54*a* of the flange 54 located near the magnetic core 3 extends longer (i.e., a greater distance) than the forward ends 22*a* and 23*a* of the flanges 22 and 23, as shown in FIG. 7. Also, the forward end 54*a* includes a recessed portion 55 facing the magnetic core 3. The gap between the recessed portion 55 and the magnetic core 3 is set at approximately 2.0 mm or less. Accordingly, the recessed portion 55 is placed in close proximity with the magnetic core 3, and the gap between the forward end 54*a* of the flange 54 and the magnetic core 3 is smaller than that of a conventional choke coil.

The above-described arrangement makes it easy for the magnetic flux generated by the normal-mode noise current to pass through the magnetic core 3 via the forward end 54*a* of the flange 54. Thus, the magnetic core 3 can be used not only as a magnetic flux path formed by the common-mode noise current but also as a magnetic flux path formed by the normal-mode noise current. As a consequence, it is possible to provide a choke coil 51 which has a large normal-mode inductance component with high efficiency.

The choke coil 61 of the fourth embodiment is shown in FIG. 8. The forward end 64*a* of the flange 64 faces the magnetic core 3 and is positioned close to the magnetic core 3. The forward end 64*a* of the flange 64 extends longer (i.e., a greater distance) than the forward ends 22*a* and 23*a* of the flanges 22 and 23. The gap between the forward end 64*a* and the magnetic core 3 is set at approximately 2.0 mm or less and is smaller than that of a conventional choke coil. This makes it easy for the magnetic flux generated by the normal-mode noise current to pass through the magnetic core 3 via the forward end 64*a* of the flange 64. Thus, the magnetic core 3 can be used not only as a magnetic flux path formed by the common-mode noise current but also as a magnetic flux path formed by the normal-mode noise current. As a result, it is possible to provide a choke coil 61 which efficiently achieves a large normal-mode inductance component.

Figure 9A:
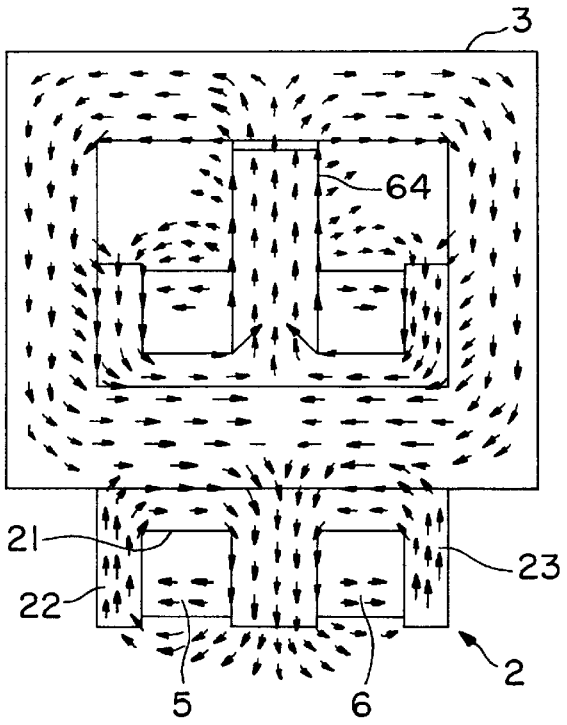
Figure 9B:
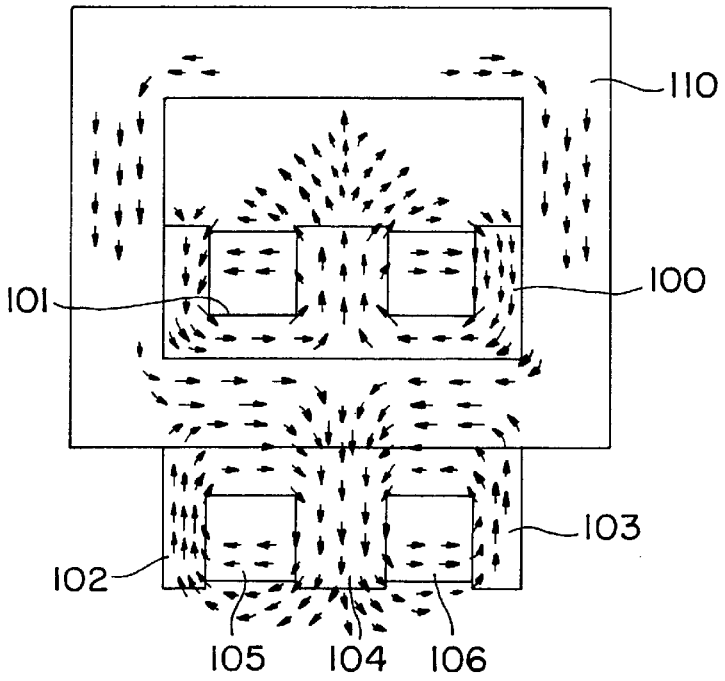
FIG. 9B PRIOR ART

FIG. 9A is a distribution diagram illustrating the simulated magnetic flux generated by a normal-mode current in the choke coil 61 of the fourth embodiment. The counterpart magnetic flux distribution of a known choke coil is shown in FIG. 9B for comparison. FIGS. 9A and 9B reveal that the choke coil 61 of the fourth embodiment exhibits a normal-mode inductance component twice as large as that of the conventional choke coil.

Figure 10:
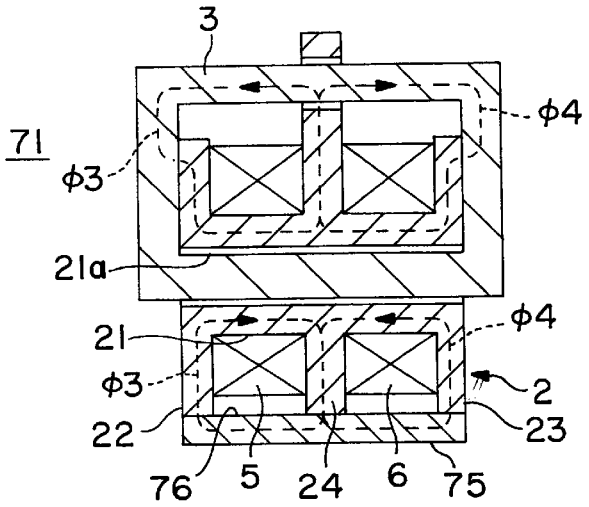
FIG. 10 is a cross-sectional view illustrating a choke coil according to a fifth exemplary embodiment of the present invention.
Figure 11:
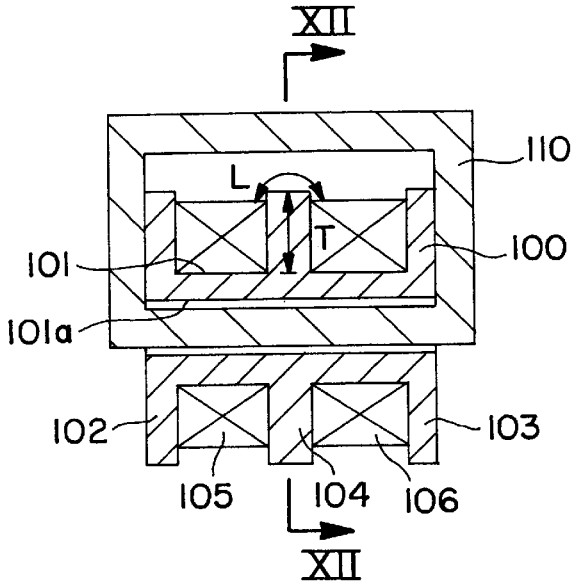
FIG. 11 PRIOR ART
FIG. 11 is a cross-sectional view illustrating a conventional choke coil.
Figure 12:
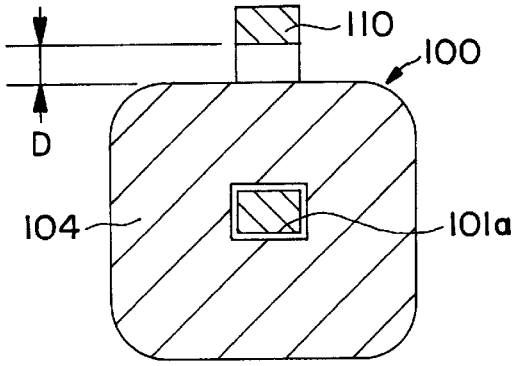
FIG. 12 PRIOR ART
FIG. 12 is a sectional view taken along line XII—XII of FIG. 11.

Fifth Embodiment: FIG. 10

A choke coil 71 of a fifth embodiment is constructed, as shown in FIG. 10, in a manner similar to the choke coil 1 of the first embodiment, except for the provision of a magnetic cover 75. The magnetic cover 75 is formed in a "U" shape in cross section and is placed such that it is separated from a region surrounded by the magnetic core 3. A recessed curved surface 76 of the cover 75 contacts the peripheral surfaces of the flanges 22, 23 and 24 of the bobbin 2, thereby forming a closed magnetic path by the bobbin 2 and the magnetic cover 75. The magnetic cover 75 can be made of a magnetic material preferably having a relative magnetic permeability of one or greater, as is the case for the material used for the bobbin 2.

In the choke coil 71 constructed as described above, two sets of magnetic flux $\phi$3 and $\phi$4 produced by the normal-mode noise current are partially converted into thermal energy in the form of eddy current loss and are progressively attenuated while circulating in the closed magnetic path formed by the bobbin 2 and the magnetic cover 75. Accordingly, the normal-mode inductance component can be further increased, thereby reducing the normal-mode noise current more efficiently.

Other Embodiments

Various modifications of the choke coils described above are envisioned. For example, the bobbin need not be completely formed from a magnetic material (e.g., the bobbin can be partially formed from a magnetic material). Moreover, the bobbin need not be formed from a material obtained by kneading a magnetic powder and a resin binder as described above, but can also be formed from a material obtained by insert-molding a magnetic member having a predetermined shape, such as a ferrite core or a dust (e.g., powder) core, into a resin.

As is seen from the foregoing description, the present invention offers the following advantages. The forward end of the flange, which is placed closer to the magnetic core, provided at the center of the core portion of the bobbin, extends longer than the forward ends of the other flanges provided at both outer ends of the core portion of the bobbin. Accordingly, the gap between the forward end of the flange provided at the center of the core portion and the magnetic core is smaller than that of a conventional choke coil. This makes it easy for the magnetic flux generated by a normal-mode noise current to pass through the magnetic core. Thus, the magnetic core can be used not only as a magnetic flux path formed by the common-mode noise current but also as a magnetic flux path formed by the normal-mode noise current. It is thus possible to provide a choke coil which obtains a large normal-mode inductance component with high efficiency.

Additionally, a magnetic cover can be used to form a closed magnetic path by the bobbin and the magnetic cover, thereby further increasing the normal-mode inductance component.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A choke coil comprising:

a bobbin having a core portion including a first end, a second end, and a central portion between said first end and said second end, and also having a hole formed therein;

a first flange provided at said first end of said core portion, a second flange provided at said second end of said core portion, and a third flange provided at said central portion of said core portion;

a pair of windings wound around an outer surface of said core portion; and a magnetic core inserted into said hole formed in said core portion, wherein said third flange is located closer to said magnetic core than said first and second flanges.

2. The choke coil according to claim 1, wherein said third flange is separated from said magnetic core by a distance of 2.0 mm or less.

3. The choke coil according to claim 1, wherein a forward distal end of said third flange is facing to at least 20% of a length of a peripheral surface of said magnetic core.

4. The choke coil according to claim 1, wherein said third flange extends further from said core portion than said first and second flanges.

5. The choke coil according to claim 4, wherein a forward distal end of said third flange is separated from said magnetic core by a distance of 2.0 mm of less.

6. The choke coil according to claim 1, wherein said third flange includes a hole formed near a forward distal end thereof, and said magnetic core passes through said hole formed in said third flange.

7. The choke coil according to claim 6, wherein a gap between said magnetic core and at least one wall portion of said hole formed in said third flange is 2.0 mm or less.

8. The choke coil according to claim 1, wherein a forward distal end of said third flange includes a projection extending therefrom toward said magnetic core.

9. The choke coil according to claim 8, wherein said projection has a first length, and a peripheral surface of said magnetic core has a second length, and wherein said first length is at least approximately 20% of said second length.

10. The choke coil according to claim 8, wherein a gap between said magnetic core and said projection is 2.0 mm or less.

11. The choke coil according to claim 1, wherein said third flange includes a recessed portion formed in a forward distal end thereof, and said magnetic core passes at least partially through said recessed portion.

12. The choke coil according to claim 11, wherein a gap between said magnetic core and at least one surface of said recess is 2.0 mm or less.

13. The choke coil according to claim 1, wherein said bobbin is at least partially formed of a magnetic material.

14. The choke coil according to claim 13, wherein said bobbin is completely formed of a magnetic material.

15. The choke coil according to claim 1, wherein said pair of windings include a first winding wound around said core portion between said first and third flanges, and a second winding wound around said core portion between said second and third flanges.

16. The choke coil according to claim 1, further including a magnetic cover disposed over a portion of said bobbin, such that, during operation of said choke coil, a closed magnetic path is formed by said magnetic cover and said bobbin.

17. The choke coil according to claim 16, wherein said cover is disposed over forward distal ends of said first, second and third flanges of said bobbin, except for at least a region of said flanges which is surrounded by said magnetic core.

18. A choke coil comprising:

a bobbin having a core portion formed of a magnetic material, and having a hole formed therein;

a plurality of flanges, each extending from said core portion of said bobbin;

windings wound around an outer surface of said core portion; and a magnetic core inserted into said hole formed in said core portion, wherein a distal portion of one of said plurality of flanges is separated from said magnetic core by approximately 2.0 mm or less.

* * * * *